US007391385B1

(12) United States Patent
Thomas

(10) Patent No.: US 7,391,385 B1
(45) Date of Patent: Jun. 24, 2008

(54) DIRECTIONAL ANTENNA

(76) Inventor: Harold J. Thomas, 341 Redwood La., La Habra, CA (US) 90631

( * ) Notice: Subject to any disclaimer, the term of this patent is extended or adjusted under 35 U.S.C. 154(b) by 0 days.

(21) Appl. No.: 11/776,455

(22) Filed: Jul. 11, 2007

(51) Int. Cl.
*H01Q 21/12* (2006.01)

(52) U.S. Cl. ..... 343/815; 343/812; 343/817; 343/818; 343/890

(58) Field of Classification Search ..... 343/812, 343/815, 817, 818, 819, 874, 890, 891
See application file for complete search history.

(56) References Cited

U.S. PATENT DOCUMENTS 2,183,784 A 12/1939 Carter
2,586,276 A 2/1952 Umstead
2,598,005 A 5/1952 Lippitt
2,655,600 A * 10/1953 Hillison ..... 343/815
3,371,348 A 2/1968 Simons
3,618,103 A 11/1971 Ringland
4,355,315 A 10/1982 Zoulek
4,398,201 A * 8/1983 Winegard et al. ..... 343/815
5,841,406 A * 11/1998 Smith ..... 343/815
2006/0139231 A1 6/2006 Kimura

* cited by examiner

*Primary Examiner*—Hoang V Nguyen
(74) *Attorney, Agent, or Firm*—Kenneth L. Green; Edgar W. Averill, Jr.; Calvin J. Eustaquio

(57) ABSTRACT

An antenna array includes an upper antenna and a lower antenna. Each antenna includes a driver dipole element and a director element horizontally spaced apart approximately one eighth wavelength from the driver dipole element. The driver dipole element is preferably approximately one half wavelength in overall length and the director element is preferably one half wavelength in length. The upper antenna is vertically spaced above the ground by approximately one wavelength and the upper and lower antennas are vertically spaced approximately one half wavelength apart. A preferred use of the antenna array is as an amateur radio antenna and a preferred frequency band is 14.0 to 14.350 MHZ corresponding to an approximately 20 meter wavelength.

13 Claims, 3 Drawing Sheets

DIRECTIONAL ANTENNA

BACKGROUND OF THE INVENTION

The present invention relates to a directional antenna and in particular, the spacing between the radiating and directing elements of the antenna.

In some radio communication applications, a radio operator finds it mandatory to communicate with a distant station located in a particular direction. This is particularly important for a radio operator when: a distant station is difficult to hear, the distant station cannot hear the radio operator, or the radio operator wishes to reduce adjacent station interference from another station located in a different direction than the distant station. To accomplish this task, directional antennas are used. Directional antennas are used to boost the effective transmitted radiated power and increase the receiving sensitivity of a station to other stations in a desired direction. Current solutions are found in multi-element antennas (such as a Yagi or a Quad). These antennas generally contain elements which are separated by a half wavelength. Such antennas are usually large in size and may be impracticable to erect in certain locations. A large antenna is also susceptible to wind loading (which could lead to eventual material failure). Additionally, there is always a desire for an antenna with higher performance.

U.S. Pat. No. 2,183,784 for "Directional Antenna," discloses an array of vertically spaced apart antennas. Each antenna comprises a driven element and a directing element, with the antennas vertically spaced apart by approximately one half wavelength. The '784 patent discloses a maximum gain with a horizontal spacing between the driven and directing elements of 0.2 wavelengths and a minimum back radiation with a horizontal spacing between 0.25 and 0.3 wavelengths. While the antenna of the '784 patent achieves some improvement over previous antennas, it also creates wind load issues and even greater improvements are desired. The '784 patent is herein incorporated by reference.

Therefore, a need remains for a directional antenna design which possesses higher gain and a more compact design than present technology antennas with larger footprints and a lesser gain.

BRIEF SUMMARY OF THE INVENTION

The present invention addresses the above and other needs by providing an antenna array including an upper antenna and a lower antenna. Each antenna includes a driver dipole element and a director element horizontally spaced apart approximately one eighth wavelength from the driver dipole element. The driver dipole element is preferably approximately one half wavelength in overall length and the director element is preferably one half wavelength in length. The upper antenna is vertically spaced above the ground by approximately one wavelength and the upper and lower antennas are vertically spaced approximately one half wavelength apart. A preferred use of the antenna array is as an amateur radio antenna and a preferred frequency band is 14.0 to 14.350 MHZ corresponding to an approximately 20 meter wavelength.

In accordance with one aspect of the invention, there is provided an antenna array including a vertical mast approximately one wavelength high and including a top, a horizontal upper beam attached to the vertical mast proximal to the top, a lower beam attached to the vertical mast approximately one half wavelength below the upper beam, an upper antenna supported by the upper beam, and a lower antenna supported by the lower beam. The upper antenna includes an upper driven dipole element having a length of approximately one half wavelength, and an upper directing element having a length of approximately one half wavelength and horizontally spaced apart approximately one eighth wavelength from the upper driven dipole element and approximately parallel to the upper driven dipole element. The lower antenna includes a lower driven dipole element having a length of approximately one half wavelength, and a lower directing element having a length of approximately one half wavelength and horizontally spaced apart approximately one eighth wavelength from the lower driven dipole element and approximately parallel to the lower driven dipole element. A first transmission line is approximately one half wavelength in length and electrically connects the upper driven dipole element to the lower driven dipole element. A second transmission line has a length of an integer multiple of one half wavelength and electrically connects the top and bottom driven dipole elements to a transmitter and a receiver.

In accordance with one aspect of the invention, there is provided an amateur radio antenna array including a vertical mast, and an upper antenna and a lower antenna. The vertical mast is approximately 68 feet and six inches high and has a top. An upper beam is attached to the vertical mast and resides proximal to the top. An upper antenna is supported by the upper beam and includes an upper driven dipole element having a length of approximately 34 feet and three inches and an upper directing element having a length of approximately 34 feet and three inches and horizontally spaced apart approximately eight feet and six inches from the upper driven dipole element and is approximately parallel to the upper driven dipole element. A lower beam is attached to the mast and vertically spaced apart approximately 34 feet and three inches below the upper beam. A lower antenna is supported by lower beam and includes a lower driven dipole element having a length of approximately 34 feet and three inches and a lower directing element having a length of approximately 34 feet and three inches and horizontally spaced apart approximately eight feet and six inches from the lower driven dipole element and approximately parallel to the lower driven dipole element. A first 50 ohm transmission line approximately 34 feet and three inches in length electrically connects the upper driven dipole element to the lower driven dipole element and a second 50 ohm transmission line has a length of an integer multiple of approximately 34 feet and three inches and electrically connects the bottom driven dipole element to a transmitter and a receiver.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
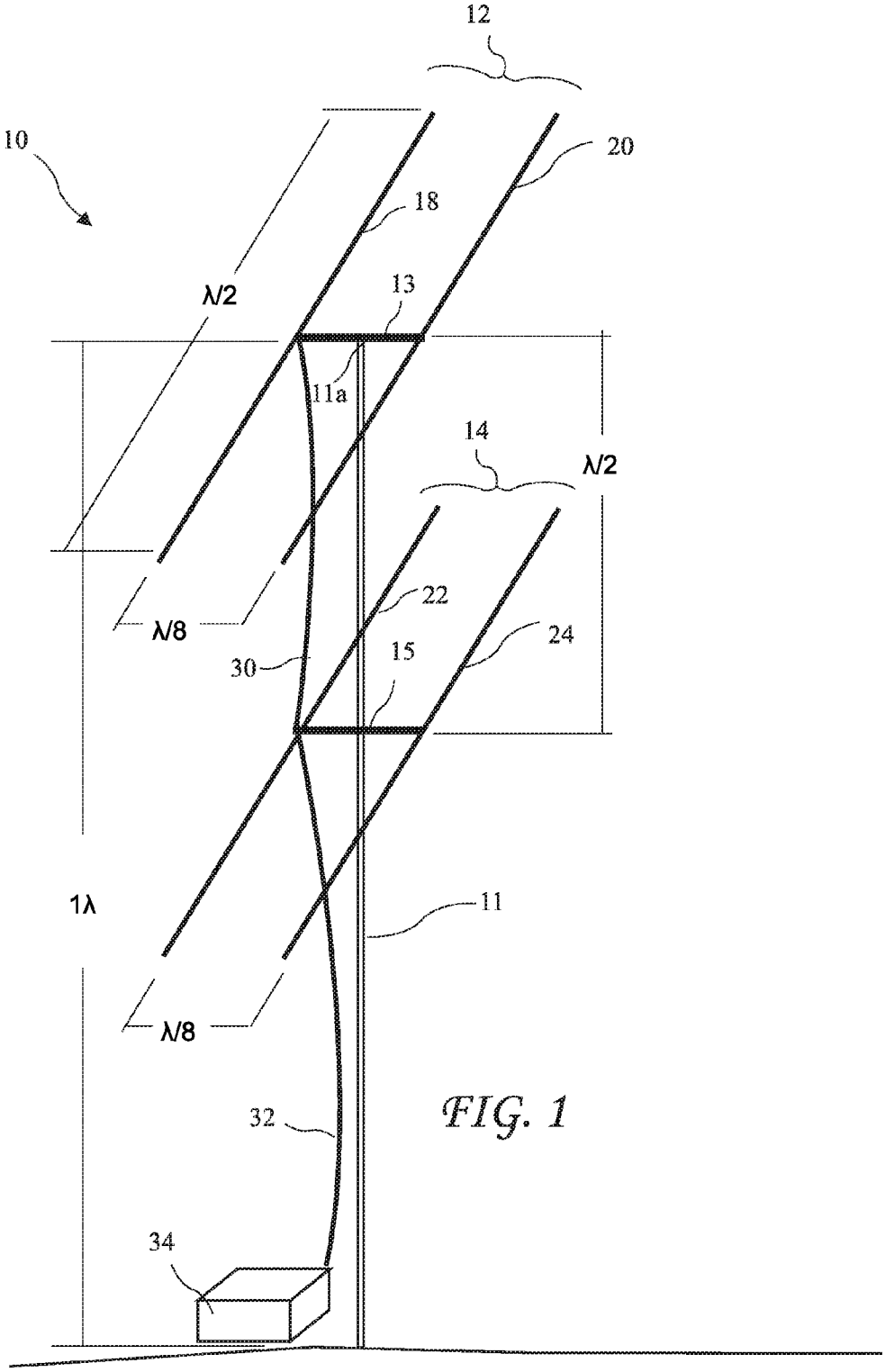
FIG. 1 is a perspective view of an antenna array according to the present invention.

A detailed perspective view of an antenna array 10 according to the present invention is shown in FIG. 1. The antenna array 10 includes an approximately vertical support (or mast) 11 having a top 11*a* and supporting an approximately horizontal upper beam 13 residing proximal to said top 11*a* and an approximately horizontal lower beam 15. Both the upper beam 13 and the lower beam 15 are preferably connected to the mast 11 at the midpoints of the beams 13 and 15 to provide a neutral mechanical balance. Upper beam 13 supports an upper antenna 12 comprising an upper driven element 18 and an upper directing element 20. The lower beam 15 supports a lower antenna 14 comprising a lower driven element 22 and a lower directing element 24.

The antenna array 10 according to the present invention achieves a significant improvement in directivity by horizontally spacing the upper and lower directing elements 20 and 24 approximately one eighth wavelength from the upper and lower driven elements 18 and 22 respectively. A preferred embodiment of the antenna array 10 according to the present invention has a vertical spacing of one half wavelength of the upper antenna 12 above the lower antenna 14, although performance gains may be achieved by other vertical spacing. Further, the addition of additional antenna elements such as driven elements, directing elements, and the like, generally reduces the performance of the antenna array 10 according to the present invention. Therefore, the preferred antenna array 10 consists essentially of two vertically spaced apart antennas with no additional vertically spaced apart antennas affecting the directivity of the antenna array 10, and the antennas 12 and 14 preferably consist essentially of only the driven elements 18 and 22 and the directing elements 20 and 24 with no additional elements affecting the directivity of the antenna array 10. A first feed line 30 connects the upper driven element 18 to the lower driven element 22, and a second feed line 32 connects the lower driven element to a transmitter/receiver 34.

Figure 2:
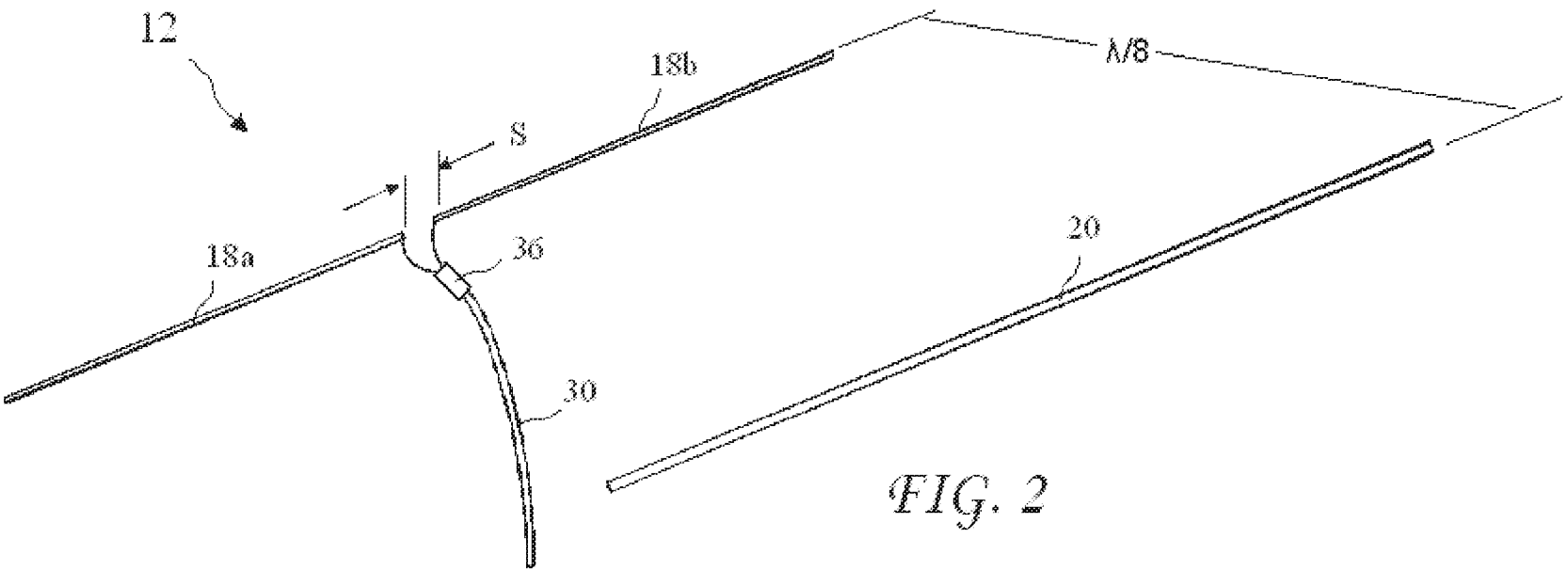
FIG. 2 is an upper antenna of the antenna array according to the present invention.

A more detailed view of the upper antenna 12 is shown in FIG. 2. The driven elements 18 and 22 and the directing elements 20 and 24 preferably have lengths of approximately one half wavelength. The upper driven element 18 is a dipole comprising two coaxial elements 18*a* and 18*b* separated by spacing S of preferably approximately two inches. The lower antenna 14 preferably has the same or similar dimensions as the upper antenna 12. The feed lines 30 and 32 are preferably RG 8U 50 Ohm coaxial cable and the coaxial elements 18*a* and 18*b* are connected to the feed line 30 through a typical coaxial cable connector, for example, PL-259 connector. The first feed line 30 is preferably approximately one half wavelength in length and the second feed line 32 is preferably an integer multiple of one wavelength in length. The first feed line and second feed line are connected by a "T" connector, preferably also using PL-259 connectors.

The upper antenna 12 elements 18 and 20 are preferably identical and parallel to the lower antenna 14 elements 22 and 24. Although the mast 11 is shown supporting both upper and lower beams 13 and 15, other vertical support may be used, and an antenna array comprising two vertically spaced apart antennas comprising driven elements, and directing elements spaced ⅛ wavelength from the driven elements, regardless of the structure supporting the antennas, is understood to come within the scope of the present invention.

The vertical support apparatus 11 is preferably a one wavelength high vertical mast. An example of a suitable material for a mast is approximately two inch outside diameter aluminum tubing but may be other materials depending on the application or preferences of the builder.

A preferred application of the present invention is an amateur radio (also known as HAM radio) antenna. Amateur radio operates of a range of frequencies between 1.8 MHZ and 440 MHZ. The different frequencies in this frequency range provide better transmission depending on parameters such as day/night, local/distant, sunspot activity, etc. An amateur radio operator selects a band and uses an antenna designed for the selected band. A popular band for amateur radio world wide, day and night operation, is 14.0 to 14.350 MHZ having a center frequency of 14.175 MHZ with a wavelength of approximately 20 meters.

An antenna array 10 suitable for the 14.0 to 14.350 MHZ band has an approximately 68 feet and six inches high mast 11, antenna element 18, 20, 22, and 24 lengths of approximately 34 feet and three inches, a horizontal spacing between driven elements 18 and 22 and directing elements 20 and 24 of approximately eight feet and six inches and a vertical spacing between upper and lower antennas of approximately 34 feet and three inches. While the above dimensions apply to an antenna for operation in the 14.0 to 14.350 MHZ band, antennas with other dimensions sized for other bands with approximately one eighth wavelength spacing between driven and directing elements are intended to come within the scope of the present invention. Example of other commonly used amateur radio bands include:

| Band (wavelength) | Frequency | Typical Use |
|---|---|---|
| 160 meters | 1.8 to 2.0 MHZ | night |
| 80 meters | 3.5 to 4.0 MHZ | night and local day |
| 40 meters | 7.0 to 7.3 MHZ | night and local day |
| 30 meters | 10.1 to 10.15 MHZ | CW and digital |
| 20 meters | 14.0 to 14.35 MHZ | world wide day and night |
| 17 meters | 18.068 to 18.168 | world wide day and night |
| 15 meters | 21.00 to 21.45 | primarily daytime |
| 12 meters | 24.89 to 24.99 | primarily daytime |
| 10 meters | 28.0 to 29.7 | Daytime during sunspot highs |
| 6 meters | 50 to 54 MHZ | local to world wide |
| 2 meters | 144 to 148 MHZ | local to medium distance |
| 70 cm | 430 to 440 MHZ | local |

Figure 3:
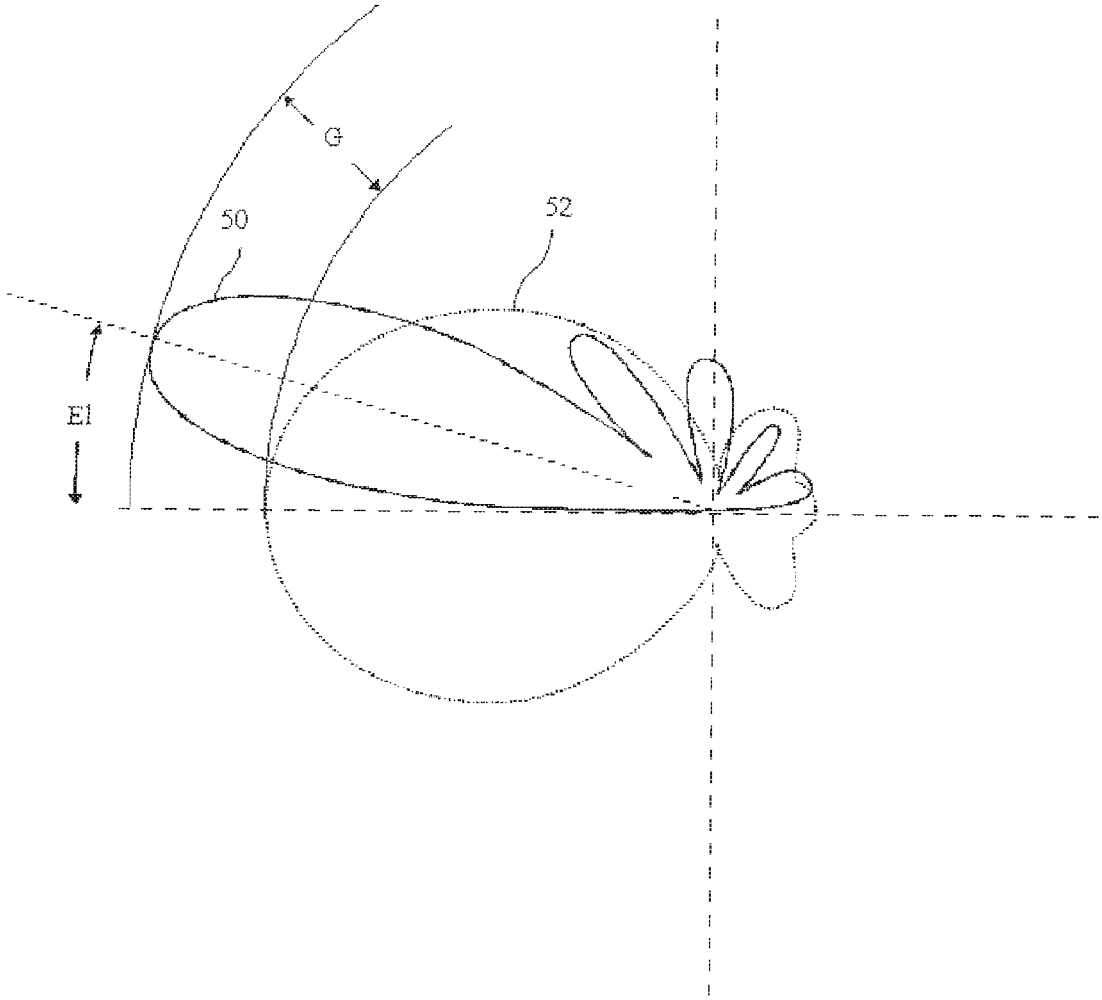
FIG. 3 is a plot comparing the directivity of an antenna according to the present invention with a convention Yagi antenna.

The antenna array 10 of the present invention was initially developed by building and testing antennas having element spacing very different from known Yagi antennas. The particular antenna array resulting in the present design demonstrated greatly improved and unexpected performance. Using the new antenna array, the radio operator was able to communicate with other ham radio operators at great distances. After observing such large and unexpected improvements, computer models were used to compare the new antenna to a conventional Yagi antenna, specifically a five element Yagi antenna. Plots were generated of a vertical slice at 1° elevation angle for both antennas and the results are shown superimposed in FIG. 3. A beam pattern 50 an antenna according to the present invention (shown as a solid line) is compared to a beam pattern 52 for typical five element Yagi antenna (shown as a dotted line). The plots show an increased directive (or gain G) of the antenna according to the present invention of approximately 5.65 dB. This increased directivity of the antenna according to the present invention roughly corresponds to the improvement observed by the radio operator and is both dramatic and unexpected. The beam 50 of the antenna 10 has an effective elevation angle El of approximately 22 degrees due to the affect of the ground on the beam 50. Because radio operators are limited to a maximum transmitting power, this increase directivity is a substantial advantage. Additionally, the antenna array 10 obtains such an improvement with a small number of elements reduces wind loading, weight, cost, and construction time.

The present invention is herein described in an embodiment having two vertically spaced apart antennas. While this embodiment is viewed as being a preferred embodiment, in some instances an antenna array with a single antenna may be advantageous, and any antenna utilizing one eighth wave length horizontal spacing between a driven element and a directing element is intended to come within the scope of the present invention.

While the invention herein disclosed has been described by means of specific embodiments and applications thereof, numerous modifications and variations could be made thereto by those skilled in the art without departing from the scope of the invention set forth in the claims.

I claim:

1. An antenna array comprising:

vertical support having a top;

a horizontal upper beam attached to said vertical support and residing proximal to said top;

an upper antenna supported by said upper beam, said upper antenna comprising:

an upper driven dipole element; and an upper directing element horizontally spaced apart approximately one eighth wavelength from said upper driven dipole element and approximately parallel to said upper driven dipole element;

a horizontal lower beam attached to the said vertical support and vertically spaced apart below said upper beam;

a lower antenna supported by said lower beam, said lower antenna comprising:

a lower driven dipole element; and a lower directing element horizontally spaced apart approximately one eighth wavelength from said lower driven dipole element and approximately parallel to said lower driven dipole element;

a first feed line electrically connecting said upper driven dipole element to said lower driven dipole element; and a second feed line electrically connecting said lower driven dipole element to a transmitter and a receiver.

2. The antenna array of claim 1, wherein the vertical support is approximately one wavelength high.

3. The antenna array of claim 2, wherein the vertical support is a vertical mast.

4. The antenna array of claim 3, wherein the lower beam is spaced approximately one half wavelength below the upper beam on the vertical mast.

5. The antenna array of claim 4, wherein said upper beam and said lower beam are attached to said vertical mast at midpoints of said upper beam and said lower beam.

6. The antenna array of claim 4, wherein the vertical mast is approximately one wavelength high.

7. The antenna array of claim 1, wherein:

the first feed line has a length of approximately one half wavelength in length; and the second feed line has a length of an integer multiple of one half wavelength.

8. The antenna array of claim 1, wherein the antenna array is an antenna array for amateur radio.

9. The antenna array of claim 8, wherein the antenna array is an antenna array for amateur radio operating in a 14.0 to 14.350 MHZ band with an approximately 20 meter wavelength.

10. An antenna array comprising:

a vertical mast approximately one wavelength high and having a top;

an upper beam attached to said mast and residing proximal to said top;

an upper antenna supported by said upper beam, said upper antenna consisting essentially of:

an upper driven dipole element having a length of approximately one half wavelength; and an upper directing element having a length of approximately one half wavelength and horizontally spaced apart approximately one eighth wavelength from said upper driven dipole element and approximately parallel to said upper driven dipole element;

a lower beam attached to said mast and vertically spaced apart below said upper beam;

a lower antenna supported by said lower beam, said lower antenna consisting essentially of:

a lower driven dipole element having a length of approximately one half wavelength; and a lower directing element having a length of approximately one half wavelength and horizontally spaced apart approximately one eighth wavelength from said lower driven dipole element and approximately parallel to said lower driven dipole element;

a first transmission line having a length of approximately one half wavelength electrically connecting said upper driven dipole element and said lower driven dipole element; and a second transmission line having a length of an integer multiple of one wavelength and electrically connecting said lower driven dipole element to a transmitter and a receiver.

11. The antenna array of claim 10, wherein the lower antenna is vertically spaced apart approximately one half wavelength below the upper antenna.

12. An amateur radio antenna array comprising:

a vertical mast approximately 68 feet six inches high and having a top;

an upper beam attached to said mast and residing proximal to said top;

an upper antenna supported by said upper beam, said upper antenna comprising:

an upper driven dipole element having a length of approximately 34 feet and three inches; and an upper directing element having a length of approximately 34 feet and three inches and horizontally spaced apart approximately 2.5 meters from said upper driven dipole element and approximately parallel to said upper driven dipole element;

a lower beam attached to said mast and vertically spaced apart below said upper beam;

a lower antenna supported by said lower beam, said lower antenna comprising:

a lower driven dipole element having a length of approximately 34 feet and three inches; and a lower directing element having a length of approximately 34 feet and three inches and horizontally spaced apart approximately 2.5 meters from said lower driven dipole element and approximately parallel to said lower driven dipole element;

a first 50 ohm transmission line approximately 34 feet and three inches in length electrically connecting said upper driven dipole element to said lower driven dipole element; and a second 50 ohm transmission line having a length of an integer multiple of approximately 34 feet and three inches and electrically connecting said lower driven dipole element to a transmitter and a receiver.

13. The amateur radio antenna array of claim 12, wherein the lower antenna is vertically spaced approximately 34 feet and three inches below the upper antenna.

* * * * *